US010181642B2

(12) United States Patent
Xue et al.

(10) Patent No.: US 10,181,642 B2
(45) Date of Patent: Jan. 15, 2019

(54) PATCH ANTENNA

(71) Applicant: City University Of Hong Kong, Hong Kong (HK)

(72) Inventors: Quan Xue, Hong Kong (HK); Juhua Liu, Guangzhou (CN)

(73) Assignee: City University of Hong Kong, Hong Kong (HK)

( * ) Notice: Subject to any disclaimer, the term of this patent is extended or adjusted under 35 U.S.C. 154(b) by 666 days.

(21) Appl. No.: 13/839,201

(22) Filed: Mar. 15, 2013

(65) Prior Publication Data

US 2014/0266960 A1 Sep. 18, 2014

(51) Int. Cl.

*H01Q 1/48* (2006.01)
*H01Q 1/38* (2006.01)
*H01Q 9/04* (2006.01)

(52) U.S. Cl.

CPC ..... *H01Q 1/48* (2013.01); *H01Q 1/38* (2013.01); *H01Q 9/0421* (2013.01); *H01Q 9/0442* (2013.01)

(58) Field of Classification Search

CPC ..... H01Q 1/48; H01Q 1/38; H01Q 9/0407; H01Q 9/0421
USPC ..... 343/848
See application file for complete search history.

(56) References Cited

U.S. PATENT DOCUMENTS 4,197,544 A * 4/1980 Kaloi ..... H01Q 1/48 343/700 MS
4,443,802 A * 4/1984 Mayes ..... H01Q 13/18 343/729
4,994,820 A * 2/1991 Suzuki ..... H01Q 1/3275 343/700 MS
5,291,210 A * 3/1994 Nakase ..... H01Q 9/40 343/700 MS
5,801,660 A * 9/1998 Ohtsuka ..... H01Q 9/0414 343/700 MS
6,181,279 B1 * 1/2001 Van Hoozen ..... 343/700 MS
(Continued)

FOREIGN PATENT DOCUMENTS

CN 101145634 A 3/2008
WO 2008/032960 A1 3/2008

OTHER PUBLICATIONS

Feng et al, CN101145634A, Mar. 19, 2008.*
(Continued)

*Primary Examiner* — Dameon E Levi
*Assistant Examiner* — Jennifer F Hu
(74) *Attorney, Agent, or Firm* — Ware, Fressola, Maguire & Barber LLP

(57) ABSTRACT

A patch antenna is disclosed as including a rectangular patch and a rectangular ground plane parallel to and spaced apart from the patch by a sheet of dielectric material. The patch has a first longer side and a second longer side which are opposite to each other and a first shorter side and a second shorter side which are opposite to each other. A first row of vias is provided adjacent the first longer side of the patch, a second row of vias being provided adjacent the second longer side of the patch, a third row of vias being provided adjacent the first shorter side of the patch, and a fourth row of vias being provided adjacent the second shorter side of the patch. Each via extends through the patch, the sheet of dielectric material and the ground plane to short the antenna.

20 Claims, 3 Drawing Sheets

(56) References Cited

U.S. PATENT DOCUMENTS

| | | | | |
|---|---|---|---|---|
| 6,369,761 | B1 * | 4/2002 | Thiam | H01Q 1/243 343/700 MS |
| 6,750,825 | B1 * | 6/2004 | Delaveaud | H01Q 1/48 343/749 |
| 6,906,674 | B2 * | 6/2005 | McKinzie, III | H01Q 1/52 343/700 MS |
| 8,350,771 | B1 * | 1/2013 | Zaghloul | H01Q 9/0435 343/700 MS |
| 8,390,520 | B2 * | 3/2013 | Lee | H01Q 9/0421 343/700 MS |
| 8,587,480 | B2 * | 11/2013 | Kim | H01Q 9/0442 343/700 MS |
| 2011/0133991 | A1 * | 6/2011 | Lee | H01Q 9/0485 343/700 MS |
| 2016/0276751 | A1 * | 9/2016 | Ueda | H01Q 9/0407 |

OTHER PUBLICATIONS

B. Jecko et al, The "Monopolar Wire Patch Antenna" concept, Antennas and Propogation, 2007, EiCap 2007, The Second European Conference on . . . , Conference Date Nov. 11-16, 2007.

Asem Al-Zoubi, et al, "A Broadband Center-Fed Circular Patch-Ring Antenna With a Monopole Like Radiation Pattern", IEEE Transactions on Antennas and Propagation, vol. 57, No. 3, pp. 789-792, (Mar. 2009).

K.L. Lau, et al, "A Wide-Band Monopolar Wire-Patch Antenna for Indoor Base Station Applications", IEEE Antennas and Wireless Propagation Letters, vol. 4, pp. 155-157 (2005).

S.L. Zuo, et al, "Enhanced bandwidth of Low Profile Sleeve Monopole Antenna for Indoor base Station Applications", Electronics Letters, vol. 46, No. 24, 2 pgs., Nov. 25, 2010.

K.L. Lau, et al, "Super-Wideband Monopolar Patch Antenna", Electronics Letters, vol. 44, No. 12, 2 pgs., Jun. 5, 2008.

K.L. Lau, et al, "A Monopole Patch Antenna With Very Wide Impedence Bandwidth", IEEE Transactions on Antennas and Propagation, vol. 53, No. 2, pp. 655-661, Feb. 2005.

Z. Y. Zhang, et al, "Sleeve Monopole Antenna for DVB-H Applications", Electronics Letters, vol. 46, No. 13, 2 pgs. Jun. 24, 2010.

Ch. Delaveaud, PH, et al, "New Kind of Microstrip Antenna: The Monopolar Wire-Patch Antenna", Electronics Letters, vol. 30, No. 1, pp. 1-2, Jan. 6, 1994.

Ka Wai Chan, et al, "Wideband Circular Patch Antenna Operated At TM01 Mode", Electronics Letters, vol. 35, No. 24, pp. 2070-2071, Nov. 25, 1999.

L. Economou, et al, "Patch Antenna Equivalent to Simple Monopole", Electronics Letters, vol. 33, No. 9, pp. 727-729, Apr. 24, 1997.

Y.-X. Guo, et al, "Wide-Band L-Probe Fed Circular patch Antenna for Conical-Pattern radiation", IEEE Transactions on Antennas and Propagation, vol. 52, No. 4, pp. 1115-1116, Apr. 2004.

Chinese Office Action dated Sep. 5, 2017, application No. 201410090314.5, 6 pages.

English Abstract, CN 200710131464, 2 pages.

* cited by examiner

PATCH ANTENNA

TECHNICAL FIELD

This invention relates to a patch antenna, and in particular a patch antenna suitable, but not exclusively, for telecommunications.

BACKGROUND OF THE INVENTION

Monopoles are widely used in wireless communication. However, conventional monopoles have a high profile of quarter wavelengths, which is too high for some devices or applications which have limited space for housing an antenna. A number of monopolar patch antennae have thus been proposed. In this connection, although monopolar patch antennae can produce a vertical polarization, the gain of monopolar patch antennae is low, especially in the horizontal plane.

It is thus an object of the present invention to provide a patch antenna in which the aforesaid shortcomings are mitigated or at least to provide a useful alternative to the trade and public.

SUMMARY OF THE INVENTION

According to the present invention, there is provided a patch antenna comprising a rectangular patch, and a ground plane substantially parallel to and spaced apart from said patch by a sheet of dielectric material, wherein said patch has a first longer side and a second longer side which are opposite to each other and a first shorter side and a second shorter side which are opposite to each other, wherein a first row of vias are provided adjacent said first longer side of said patch, a second row of vias are provided adjacent said second longer side of said patch, a third row of vias are provided adjacent said first shorter side of said patch, and a fourth row of vias are provided adjacent said second shorter side of said patch, and wherein each said via extends through said patch, said sheet of dielectric material and said ground plane to short said antenna.

BRIEF DESCRIPTION OF THE DRAWINGS

A preferred embodiment of the present invention will now be described, by way of example only, with reference to the accompanying drawings, in which.

DETAILED DESCRIPTION OF A PREFERRED EMBODIMENT

Figure 1B:
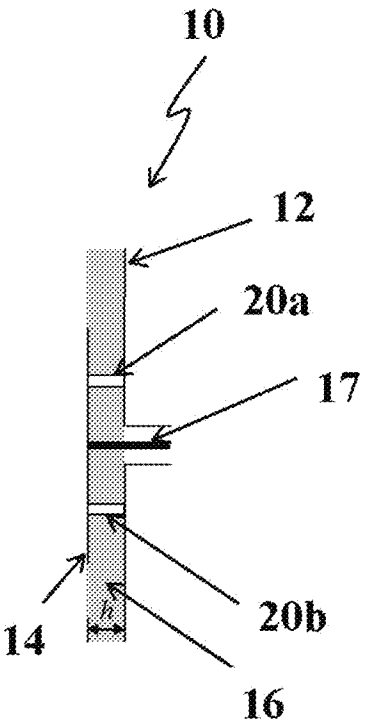
FIG. 1B shows a cross-sectional side view of the patch antenna shown in FIG. 1A.
Figure 1A:
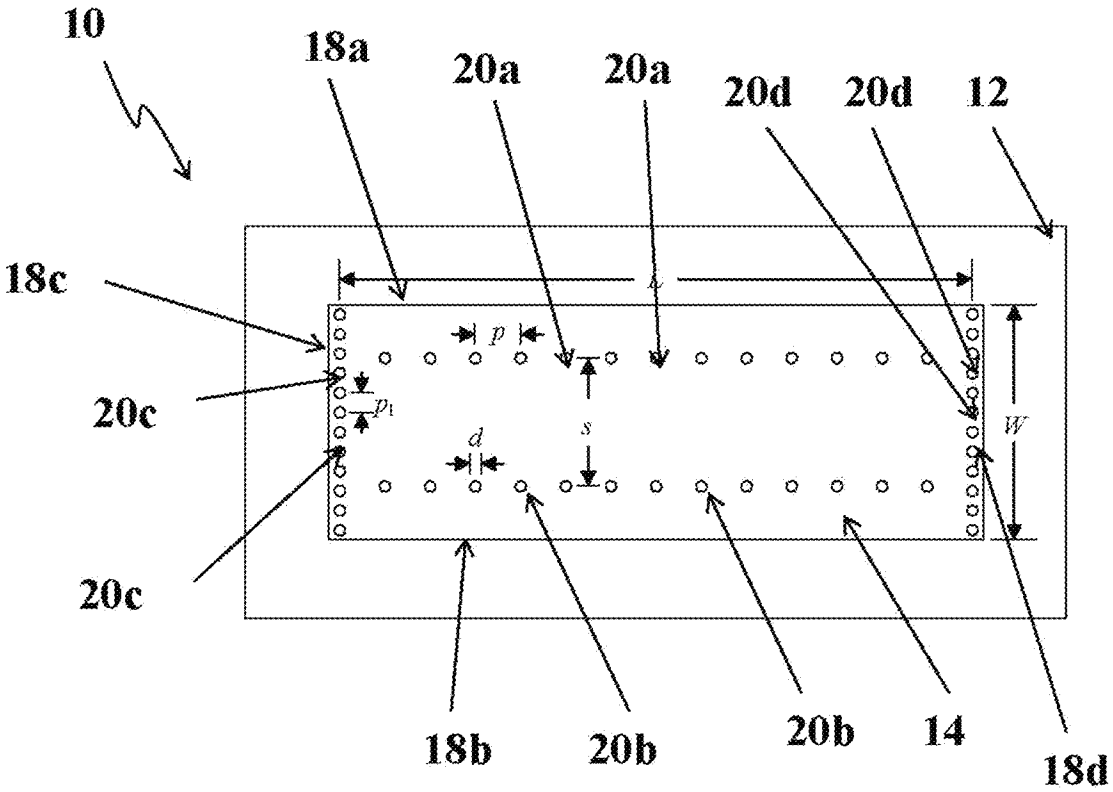
FIG. 1A shows a front view of a long rectangular microstrip patch antenna according to a preferred embodiment of the present invention.

A long rectangular microstrip patch antenna according to a preferred embodiment of the present invention is shown in FIGS. 1A and 1B, and generally designated as 10. Briefly stated, the antenna 10 is constructed on a long microstrip patch antenna with conducting vias which short the antenna.

As shown in FIGS. 1A and 1B, the antenna 10 includes a rectangular ground plane 12 and a rectangular patch 14 which are parallel to each other, and spaced apart from each other by and engaged with a planar substrate 16 made of a dielectric material. For example, the substrate 16 may be a printed circuit board (PCB) of a dielectric constant $\varepsilon_r$ of 2.33. The patch 14 is fed at the centre with a 50Ω coaxial transmission line 17. The ground plane 12 may be in the shape of a square.

The patch 14 has a pair of longer sides 18*a*, 18*b* which are opposite to and parallel to each other, and a pair of shorter sides 18*c*, 18*d* which are opposite to and parallel to each other. A straight row of vias 20*a* are provided adjacent and along the longer side 18*a*; a straight row of vias 20*b* are provided adjacent and along the longer side 18*b*; a straight row of vias 20*c* are provided adjacent and along the shorter side 18*c*; and a straight row of vias 20*d* are provided adjacent and along the shorter side 18*d*. The row of vias 20*a* are parallel to the row of vias 20*b*; and the row of vias 20*c* are parallel to the row of vias 20*d*.

Each of the vias 20*a*, 20*b*, 20*c*, 20*d* extends through the ground plane 12, the substrate 16, and the circular patch 14, and electrically conducts the ground plane 12 with the patch 14, thus shorting the antenna 10. The vias 20*a*, 20*b*, 20*c*, 20*d* may be made of wires of an electrically conducting material, such as copper wires.

More particularly, the dimensions of the antenna 10 may be as follows:

a. the distance L between the row of vias 20*c* and the row of vias 20*d* is 62.4 mm;

b. the length W of each of the shorter sides 18*c*, 18*d* is 30.4 mm;

c. the thickness h of the substrate 16 is 1.57 mm;

d. the diameter d of each of the vias 20*a*, 20*b*, 20*c*, 20*d* is 0.6 mm;

e. the distance s between the row of vias 20*a* and the row of vias 20*b* is 16.8 mm;

f. the distance p between successive vias 20*a* along the row of vias 20*a* and that between successive vias 20*b* along the row of vias 20*b* is 3.9 mm;

g. the distance $p_1$ between successive vias 20*c* along the row of vias 20*c* and that between successive vias 20*d* along the row of vias 20*d* is 1.5 mm; and h. the ground plane 12 is in a square shape with the length of each side being 100 mm.

Figure 2:
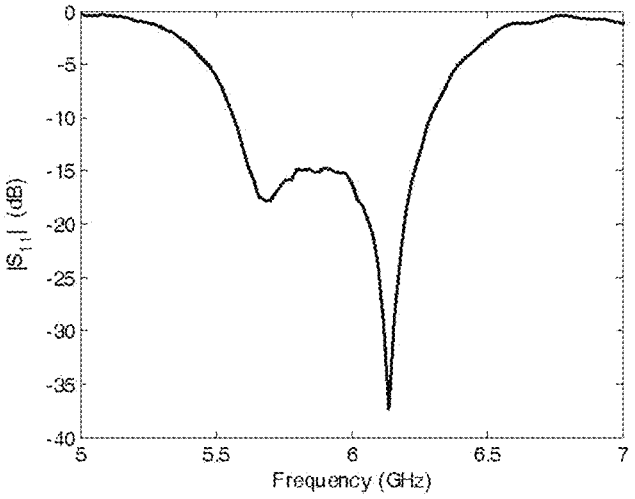
FIG. 2 shows measured results for the reflection coefficient ($S_{11}$) of the antenna shown in FIGS. 1A and 1B.

FIG. 2 shows measured results for the reflection coefficient ($S_{11}$) of the patch antenna 10. "HFSS" (which originally stands for "High Frequency Structure Simulator") is a commercial finite element method solver for electromagnetic structures, and is a commercial tool used for antenna design. The patch antenna 10 provides a fractional bandwidth of about 12.8%, and works in the band from 5.56 GHz to 6.3 GHz.

The profile of the patch antenna 10 is thus only about 0.03 wavelengths in free space. In addition, the patch antenna 10 is said to be "long" in that the distance L between the row of vias 20*c* and the row of vias 20*d* is equal to or more than one wavelength in free space. In this particular embodiment, the distance L is about 1.25 wavelengths in free space.

Figure 3:
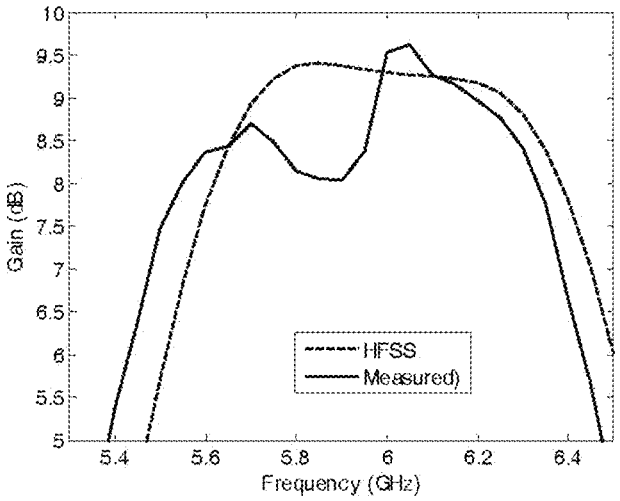
FIG. 3 shows simulated and measured results for the maximum gains of the antenna shown in FIGS. 1A and 1B.

FIG. 3 shows simulated and measured results for the maximum gains of the patch antenna 10. It can be seen that the maximum gain of the patch antenna 10 is about 9 dBi. Very slight disagreement due to measured errors is observed between the simulated and measured results.

Figure 4:
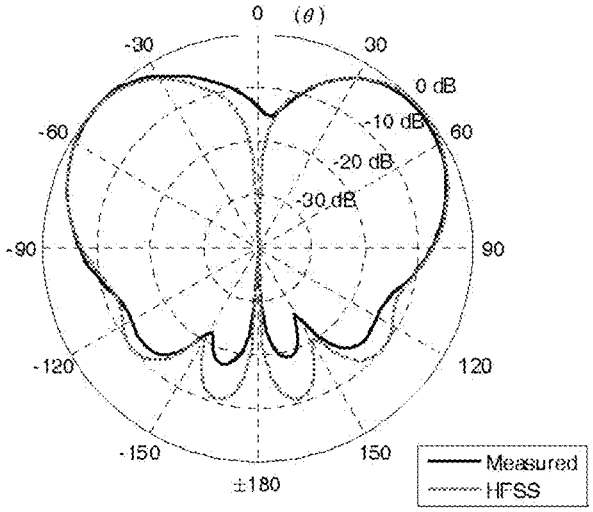
FIG. 4 shows simulated and measured results for the elevation patterns of the antenna shown in FIGS. 1A and 1B at 5.65 GHz.

FIG. 4 shows simulated and measured results for the elevation patterns of the patch antenna 10 at 5.65 GHz. It is found that the patch antenna 10 produces a vertical polarization in the horizontal plane, as do conventional monopole antennae. The radiation pattern in the main elevation plane of the patch antenna 10 has a conical shape, which is similar to that produced by a conventional monopole antenna.

Figure 5:
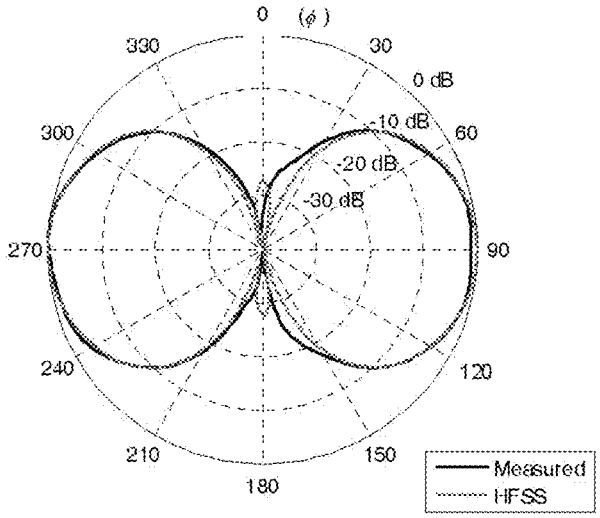
FIG. 5 shows simulated and measured results for the azimuth patterns of the antenna shown in FIGS. 1A and 1B at 5.65 GHz.

FIG. 5 shows simulated and measured results for the azimuth patterns of the patch antenna 10. It can be seen that the azimuth pattern in the horizontal plane has an "8" shape, meaning that the antenna 10 radiates at both forward and backward endfires. The radiation patterns are stable in the frequency band of interest.

It should be understood that this type of patch antenna can be designed for other frequencies besides the band illustrated herein.

The patch antenna 10 is of a very low profile, high gain and wide bandwidth. It has a low cost, low weight, and a simple structure that can be easily fabricated on a PCB, and thus can be easily produced in the industry. The patch antenna 10 can be used in indoor base stations, vehicles, airplanes, helicopters, etc. The patch antenna 10 can cooperate with conventional monopoles as the patch antenna 10 also produces a conical radiation pattern in the main elevation plane and vertical polarization at backward and forward endfires.

It should be understood that the above only illustrates an example whereby the present invention may be carried out, and that various modifications and/or alterations may be made thereto without departing from the spirit of the invention. It should also be understood that various features of the invention which are, for brevity, described here in the context of a single embodiment, may also be provided separately or in any appropriate sub-combinations.

The invention claimed is:

1. A patch antenna comprising:

a rectangular patch fed with a coaxial transmission line, and a ground plane substantially parallel to and spaced apart from said patch by a sheet of dielectric material, wherein said patch has a first longer side and a second longer side which are opposite to each other and a first shorter side and a second shorter side which are opposite to each other, wherein a first row of vias are provided adjacent said first longer side of said patch, a second row of vias are provided adjacent said second longer side of said patch, a third row of vias are provided adjacent said first shorter side of said patch, and a fourth row of vias are provided adjacent said second shorter side of said patch, and wherein each said via extends through said patch, said sheet of dielectric material and said ground plane to short said antenna.

2. A patch antenna according to claim 1 wherein said ground plane is the shape of a rectangle or square.

3. A patch antenna according to claim 1 wherein each of said first row of vias, said second row of vias, said third row of vias and said fourth row of vias are arranged in a straight row.

4. A patch antenna according to claim 3 wherein said first row of vias are substantially parallel to said second row of vias.

5. A patch antenna according to claim 3 wherein said third row of vias are substantially parallel to said fourth row of vias.

6. A patch antenna according to claim 5 wherein the distance between said third row of vias and said fourth row of vias is equal to or more than one wavelength in free space.

7. A patch antenna according to claim 6 wherein the distance between said third row of vias and said fourth row of vias is substantially 1.25 wavelengths in free space.

8. A patch antenna according to claim 5 wherein the distance between said third row of vias and said fourth row of vias is substantially 62.4 mm.

9. A patch antenna according to claim 1 wherein the length of said first shorter side is substantially 30.4 mm.

10. A patch antenna according to claim 1 wherein the thickness of said sheet of dielectric material is substantially 1.57 mm.

11. A patch antenna according to claim 4 wherein the distance between said first row of vias and said second row of vias is substantially 16.8 mm.

12. A patch antenna according to claim 1 wherein each said via is of a diameter of substantially 0.6 mm.

13. A patch antenna according to claim 1 wherein the distance between the centres of successive vias in said first row of vias is substantially 3.9 mm.

14. A patch antenna according to claim 1 wherein the distance between the centres of successive vias in said third row of vias is substantially 1.5 mm.

15. A patch antenna according to claim 1 wherein the distance between the centres of successive vias in said first row of vias is longer than the distance between the centres of successive vias in said third row of vias.

16. A patch antenna according to claim 1, wherein a radiation pattern in an elevation plane of the patch antenna is conical in shape.

17. A patch antenna according to claim 1, wherein an azimuth radiation pattern in a horizontal plane of the patch antenna has an "8" shape.

18. A patch antenna according to claim 17, wherein a radiation pattern in an elevation plane of the patch antenna is conical in shape.

19. A patch antenna according to claim 1, wherein said first longer side and said second longer side which are opposite to each other, together with said first shorter side and said second shorter side which are opposite to each other, form a rectangular boundary of said rectangular patch, wherein each of said first row of vias, said second row of vias, said third row of vias and said fourth row of vias are arranged within said rectangular boundary.

20. A patch antenna according to claim 19, wherein said ground plane has a ground plane boundary, said sheet of dielectric material has a dielectric material boundary, wherein said ground plane is singular, said rectangular patch alone is spaced apart from said ground plane and substantially parallel thereto by said sheet of dielectric material, and wherein a rectangular area of said rectangular boundary of said rectangular patch is smaller than an area of said ground plane boundary and is smaller than an area of said dielectric material boundary.

* * * * *